US010252839B2

(12) United States Patent
Chen

(10) Patent No.: US 10,252,839 B2
(45) **Date of Patent: *Apr. 9, 2019**

(54) FASTENER CONTAINER

(71) Applicant: Min-Chien Chen, Tainan (TW)

(72) Inventor: Min-Chien Chen, Tainan (TW)

(73) Assignee: YI-HSIN CHEN, Kaoshiung (TW)

( * ) Notice: Subject to any disclaimer, the term of this patent is extended or adjusted under 35 U.S.C. 154(b) by 34 days.

This patent is subject to a terminal disclaimer.

(21) Appl. No.: 15/364,140

(22) Filed: Nov. 29, 2016

(65) Prior Publication Data

US 2018/0148233 A1 May 31, 2018

(51) Int. Cl.

| | |
|---|---|
| ***B25H 3/02*** | (2006.01) |
| ***B65D 43/16*** | (2006.01) |
| ***B65D 43/24*** | (2006.01) |
| ***B65D 51/26*** | (2006.01) |

(52) U.S. Cl.

CPC ..... *B65D 43/24* (2013.01); *B25H 3/02* (2013.01); *B65D 43/161* (2013.01); *B65D 51/26* (2013.01)

(58) Field of Classification Search

CPC ..... B65D 43/24; B65D 51/26; B65D 43/161; B25H 3/02

USPC ..... 206/338

See application file for complete search history.

(56) References Cited

U.S. PATENT DOCUMENTS 7,165,695 B2 1/2007 Choi

*Primary Examiner* — Anthony D Stashick
*Assistant Examiner* — James M Van Buskirk
(74) *Attorney, Agent, or Firm* — J.C. Patents

(57) ABSTRACT

The fastener container in the present invention includes a lid and a receptacle base as main components combined together. Said lid has a first section and a second section which are connected by a hinge. This invention used the first prominent portion with flexible cushioning effect and the pressing member of the first prominent portion of the first section, and the blocking member and the third recess of the second prominent portion of the second section to reduce the wear and tear between the pressing member and the blocking member, it also can prevent the pressing member from squeezing the blocking member for a long time to result in a problem that the pressing member and the blocking member are deformed and the first section can not be held in the open position, so that the service life of the lid can be extended and the user can easily open or close the first section of the lid to take or place screws or other items.

11 Claims, 10 Drawing Sheets

FASTENER CONTAINER

BACKGROUND OF THE INVENTION

1. Field of the Invention

This invention relates to a fastener container, particularly to a container having a first section of the lid which can be continuously held in the open position when the user opens the lid, so that the user can easily put his/her hand into the receptacle base to take or put the screws or other items.

2. Description of the Prior Art

The prior art such as U.S. Pat. No. 7,165,695 "Dispensing container for dispensing fasteners" which is consisted of a receptacle base 11 and a lid 23, the lid has a front section 24 and a rear section 25 which are connected by a hinge 26. The rear end of the front section 24 set with a projection portion 50 included a portion of planar upper panel 43 and five inclined, vertical or near vertical panels 52-56. The front end of the rear section 25 set with a socket 51 provided five inclined, vertical or nearly vertical panels 57-62. The surface 53 and 55 carry ribs 63 and 64 to ensure a tight fit that will hold lid front section 24 in the open position. However, with the increase in the number of lid 23 used, the wear and tear between the ribs 63, 64 and the surface 53, 55 will make it more and more difficult to be fitted tightly with each other, eventually causing the front section 24 of the lid 23 to fail to hold in the open position.

Moreover, the container has only a receptacle base 11 for receiving various items, so if all the items are placed in the receptacle base 11, some commonly used tools will not be easy to take, resulting in the use of inconvenient.

For this reason, the inventor of this invention, having much experience in designing and manufacturing container and its related products, understands and researches the problem of the foregoing prior art and hence devised this invention.

SUMMARY OF THE INVENTION

The objective of this invention is to offer a new fastener container to reduce the wear and tear between the pressing member and the blocking member of the lid, it also can prevent the pressing member from squeezing the blocking member for a long time to result in a problem that the pressing member and the blocking member are deformed and the first section can not be held in the open position, so that the service life of the lid can be extended and the user can easily open or close the first section of the lid to take or place screws or other items.

The fastener container in the present invention includes a lid and a receptacle base as main components combined together. Said lid has a first section and a second section which are connected by a hinge; the periphery of said first section and second section are respectively provided with a first circumferential wall and a second circumferential wall. A first recess is set on the inner surface of said first circumferential wall, and a second recess is set on the inner surface of said second circumferential wall. The first section of the lid has a first prominent portion, a curved long groove is provided on the rear side of the first prominent portion and parallel to said hinge, a pressing member is set on the rear side of the curved long groove. The second section of the lid has a second prominent portion, a blocking member is provided on the front side of the second prominent portion and parallel to said hinge, a third recess is set below the blocking member, the underside of the first prominent portion of the lid is provided with tool holder(s).

The fastener container of present invention, among which said receptacle base has a space and the annular side wall of the receptacle base is provided in conformance with the shape of the lid, an engaging circumference is set on the top of the receptacle base. The front side of said engaging circumference has a first engaging flange which is provided to match with said first recess, and the rear side of said engaging circumference has a second engaging flange which is provided to match with said second recess.

The fastener container of present invention, among which said pressing member can be a rib or a plurality of spaced projections, the spaced projections allows the pressing member to be more easily pressed into the third recess.

The fastener container of present invention, among which said tool holder can be the V-shape holder or U-shape holder.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
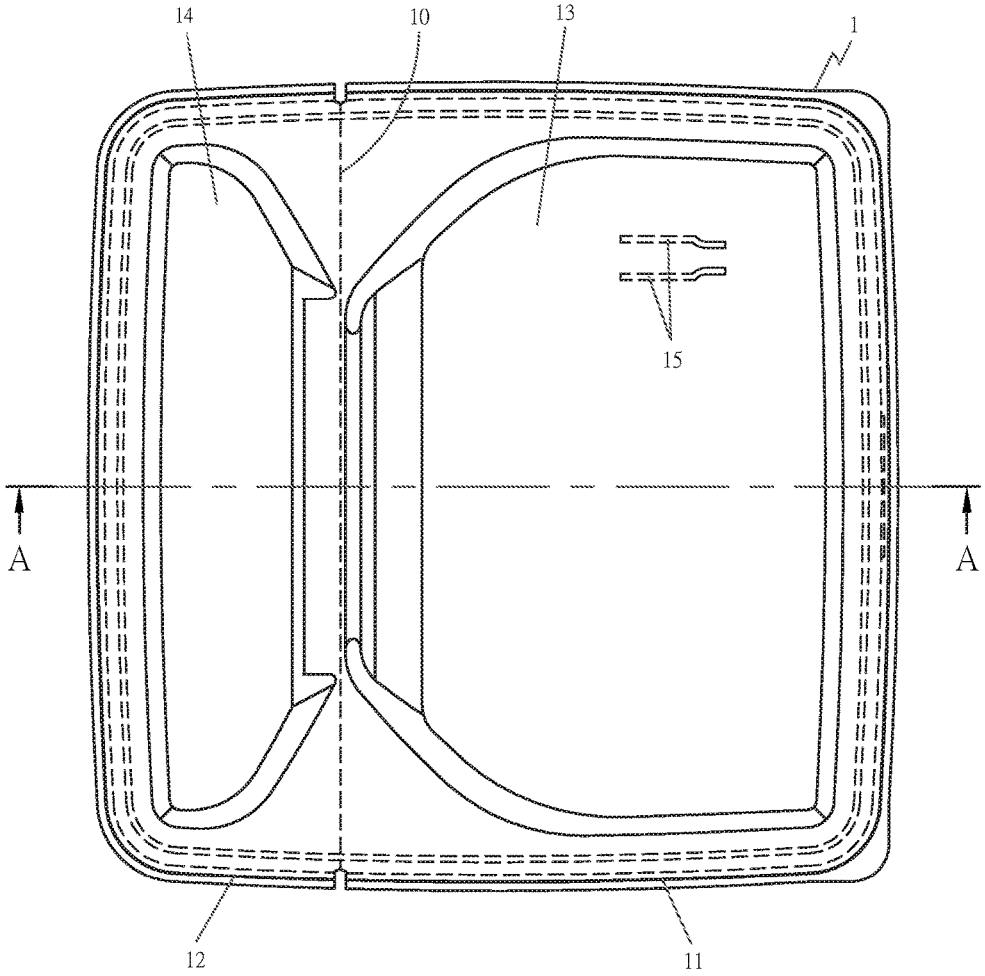
FIG. 1 is an top view of the lid in the present invention.
Figure 2:
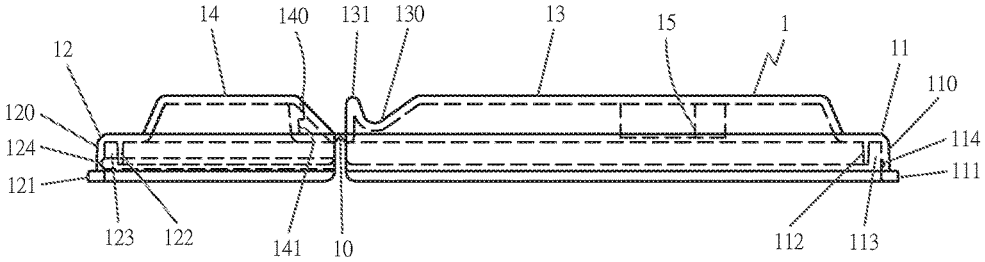
FIG. 2 is an left side view of the lid in the present invention.
Figure 3:
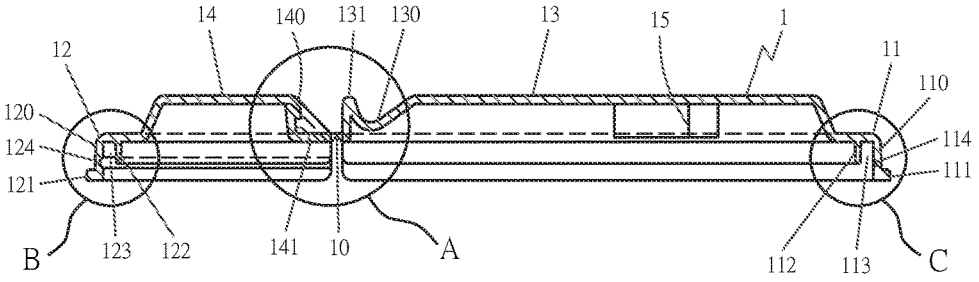
FIG. 3 is an enlarged sectional view of A-A shown in FIG. 1.
Figure 4:
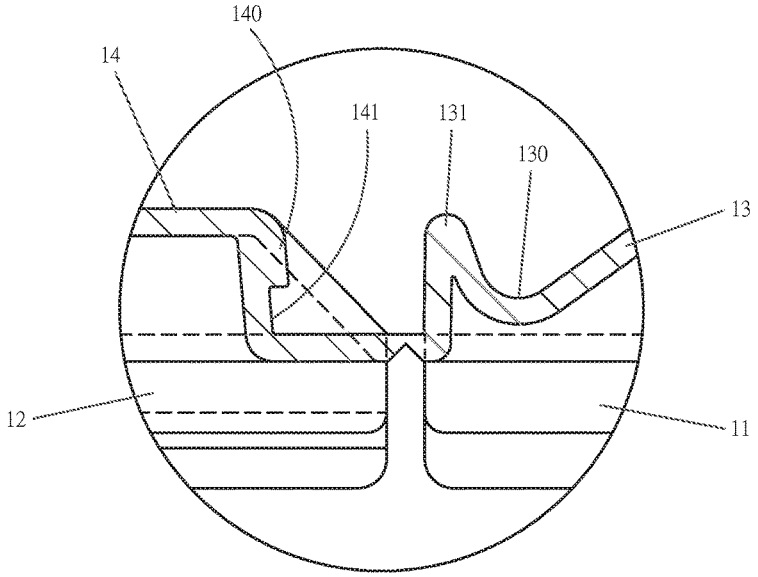
FIG. 4 is an enlarged view of area A shown in FIG. 3.
Figure 5:
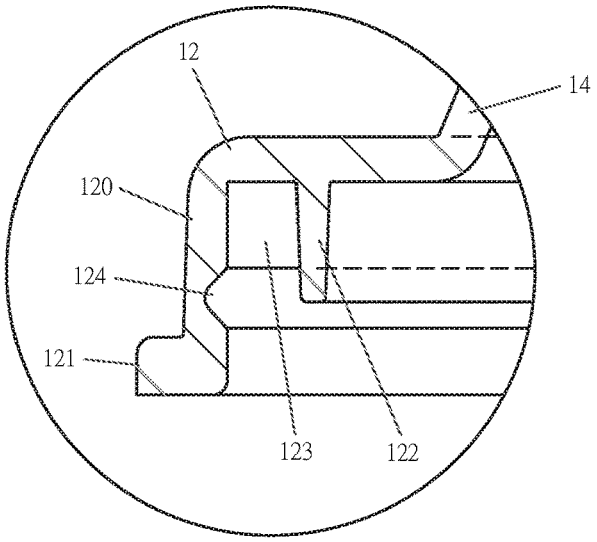
FIG. 5 is an enlarged view of area B shown in FIG. 3.
Figure 6:
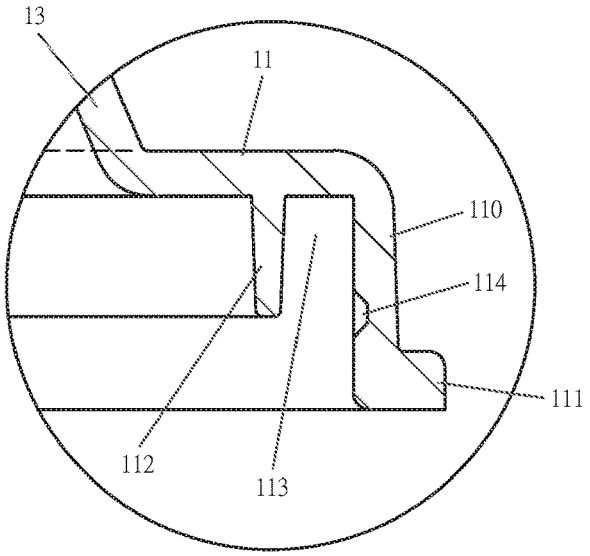
FIG. 6 is an enlarged view of area C shown in FIG. 3.
Figure 7:
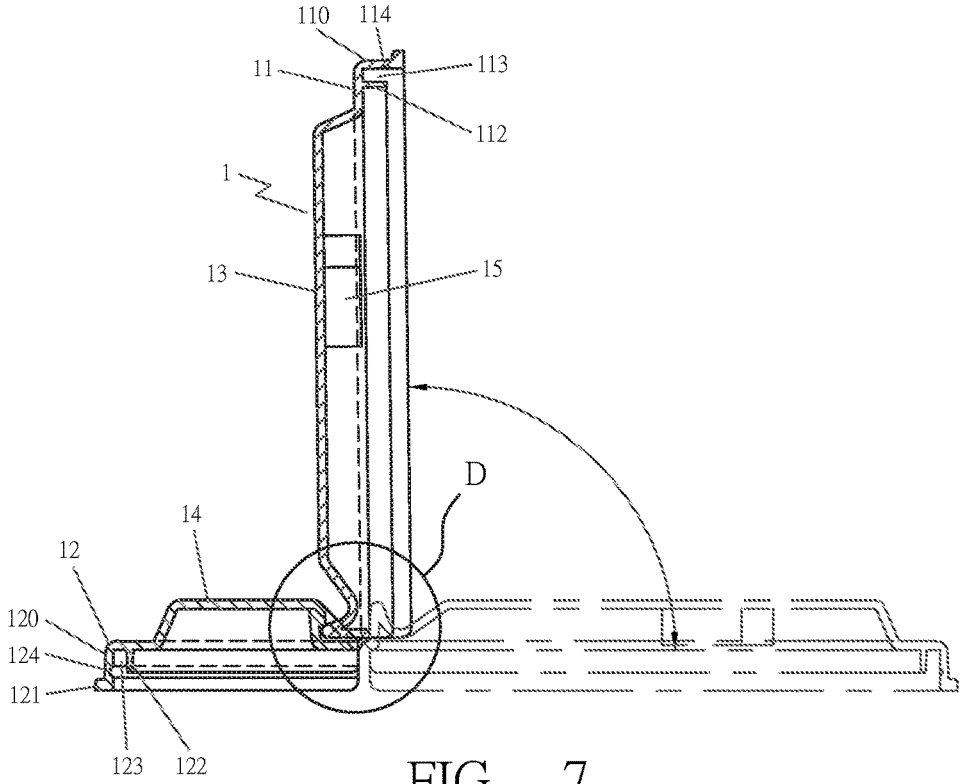
FIG. 7 is an left side view of the lid in the present invention, wherein the first section of lid is in the open position.
Figure 8:
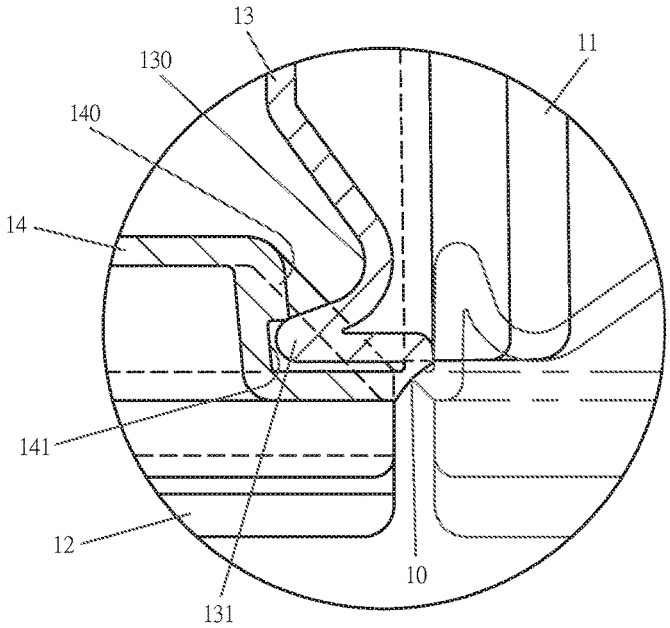
FIG. 8 is an enlarged view of area D shown in FIG. 7.

A preferred embodiment of a fastener container in the present invention, as shown in FIG. 1-19, includes a lid 1 and a receptacle base 2 as main components combined together. The lid 1 and the receptacle base 2 can be made of plastic, rubber or other elastic material.

As shown in FIGS. 1 to 10, the lid 1 has a first section 11 and a second section 12 which are connected by a hinge 10. The size of the first section 11 may be greater than, equal to or less than the size of the second section 12 in accordance with the use requirement.

The periphery of the first section 11 and second section 12 are respectively provided with a first circumferential wall 110 and a second circumferential wall 120, and a first reinforced ring 111 and a second reinforced ring 121 are separately set on the bottom of said first circumferential wall 110 and second circumferential wall 120 to strengthen the structural strength of the circumferential wall 110, 120.

A first inner circumference 112 is provided inside the first circumferential wall 110 of the first section 11, and a first groove 113 is formed between the first circumferential wall 110 and the first inner circumference 112. A first recess 114 is set on the inner surface of said first circumferential wall 110. A second inner circumference 122 is provided inside the second circumferential wall 120 of the second section 12, and a second groove 123 is formed between the second circumferential wall 120 and the second inner circumference 122. A second recess 124 is set on the inner surface of said second circumferential wall 120. Said first groove 113 and second groove 123 are engaged with each other to form an annular groove.

The first section 11 of the lid 1 has a first prominent portion 13, a curved long groove 130 is provided on the rear side of the first prominent portion 13 and parallel to said hinge 10. A pressing member 131 is set on the rear side of the curved long groove 130, and said curved long groove 130 can be used to provide the effect that the pressing member is elastically cushioned when the pressing member 131 is pressed, thereby reducing the wear and tear of the pressing member 131. Said pressing member 131 can be a rib or a plurality of spaced projections, the spaced projections allows the pressing member 131 to be more easily pressed into the third recess 141.

The second section 12 of the lid 1 has a second prominent portion 14, a blocking member 140 is provided on the front side of the second prominent portion 14 and parallel to said hinge 10. A third recess 141 is set below the blocking member 140, so that the pressing member 131 passing through the blocking member 140 can be confined in the third recess 141.

Figure 9:
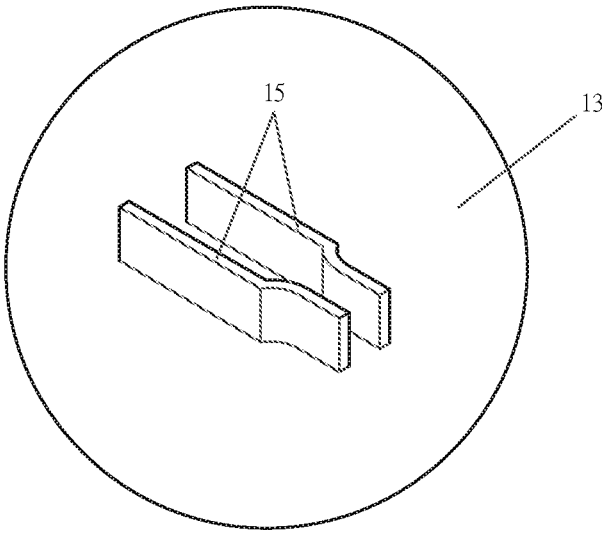
FIG. 9 is an enlarged view of the V-shape tool holder in the present invention.
Figure 10:
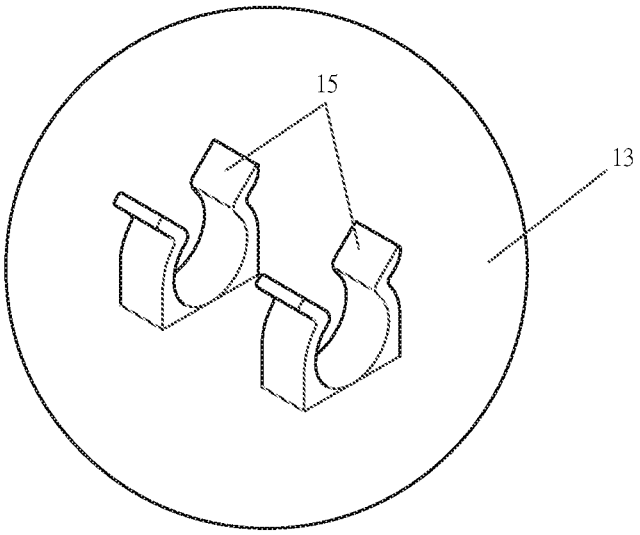
FIG. 10 is an enlarged view of the U-shape tool holder in the present invention.
Figure 11:
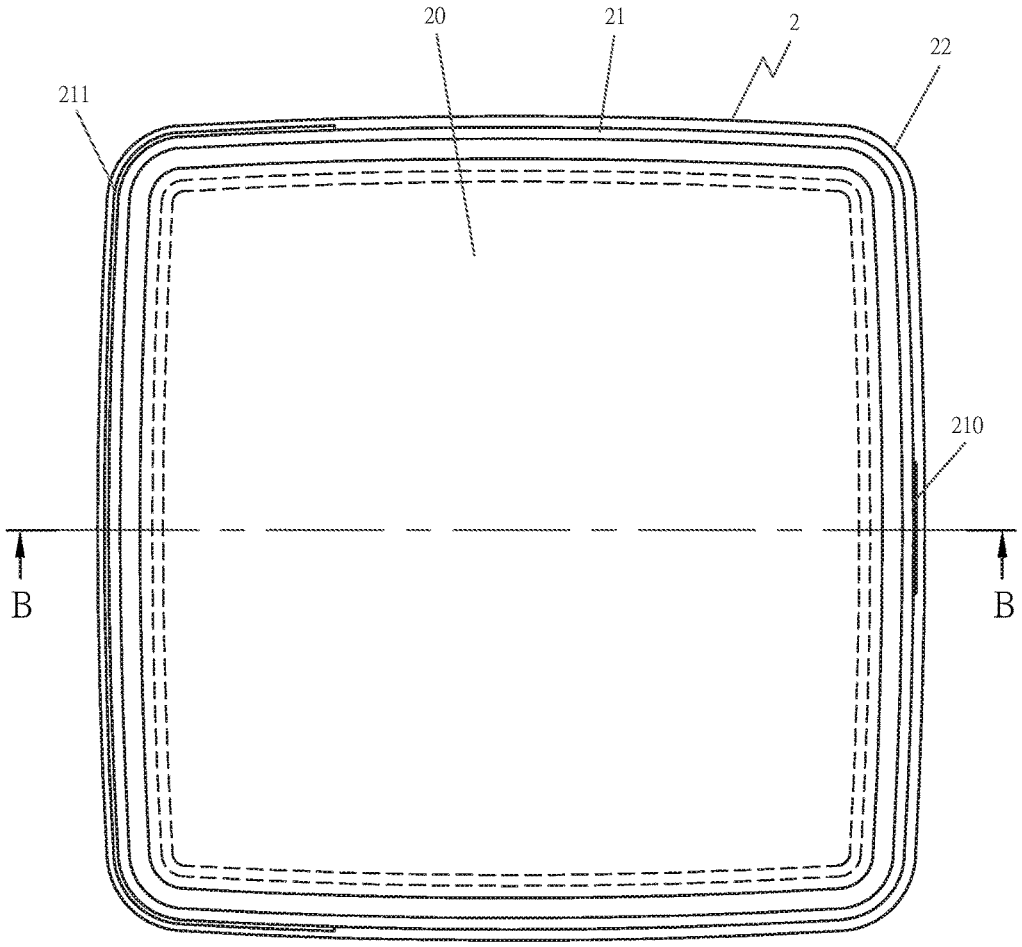
FIG. 11 is an top view of the receptacle base in the present invention.
Figure 12:
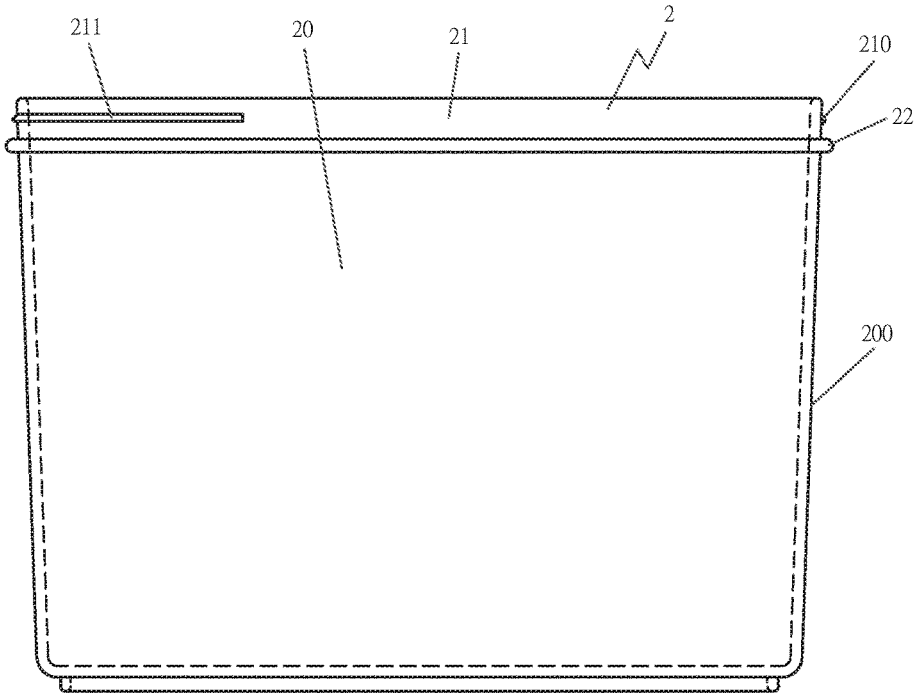
FIG. 12 is an left side view of the receptacle base in the present invention.
Figure 13:
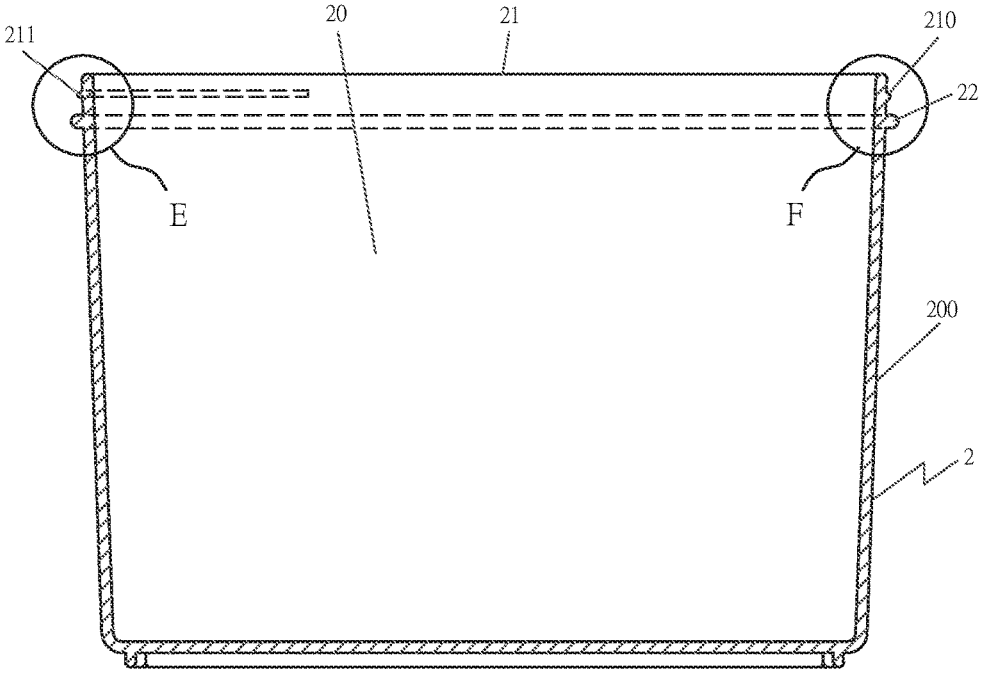
FIG. 13 is an enlarged sectional view of B-B shown in FIG. 11.
Figure 14:
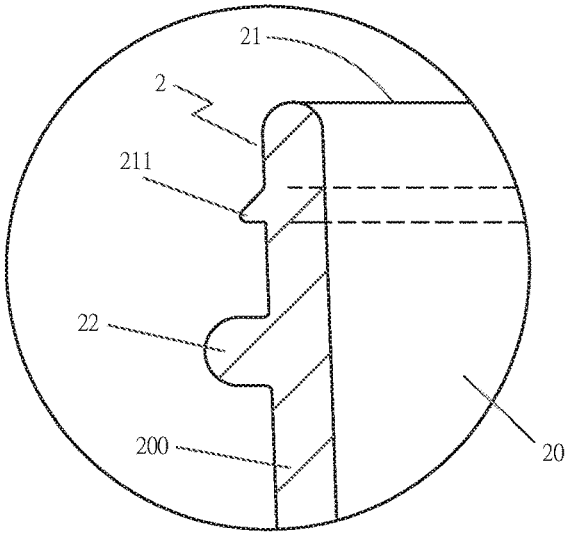
FIG. 14 is an enlarged view of area E shown in FIG. 13.
Figure 15:
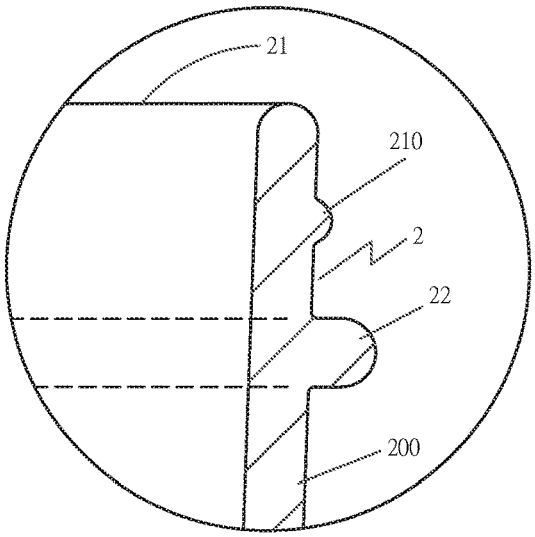
FIG. 15 is an enlarged view of area F shown in FIG. 13.

The underside of the first prominent portion 13 of the lid 1 is provided with various types of tool holders 15, such as V-shape holder (as shown in FIGS. 9) or U-shape holder (as shown in FIGS. 10), to utilize the tool holders 15 to receive a variety of tools and the tools can be concealed in the first prominent portion 13 so that the space of the first section 11 can be fully utilized.

As shown in FIGS. 11 to 15, said receptacle base 2 has a space 20 to contain screws or other items, the annular side wall 200 of the receptacle base 2 is provided in conformance with the shape of the lid 1. A engaging circumference 21 is set on the top of the receptacle base 2 and a protrudent ring 22 is provided between the annular side wall 200 and the engaging circumference 21 to strengthen the structure of the receptacle base 2 and to limit the final engaging position and depth of the lid 1. So that the user can know whether the lid 1 has been tight with the receptacle base 2.

The front side of said engaging circumference 21 has a first engaging flange 210 which is provided to match with said first recess 114, and the rear side of said engaging circumference 21 has a second engaging flange 211 which is provided to match with said second recess 124. The total length of the first engaging flange 210 may be less than the total length of the second engaging flange 211, so that the first section 11 will be easier to open than the second section 12. The shape of the first engaging flange 210 and the second engaging flange 211 is corresponded to the shape of said first recess 114 and second recess 124.

Figure 16:
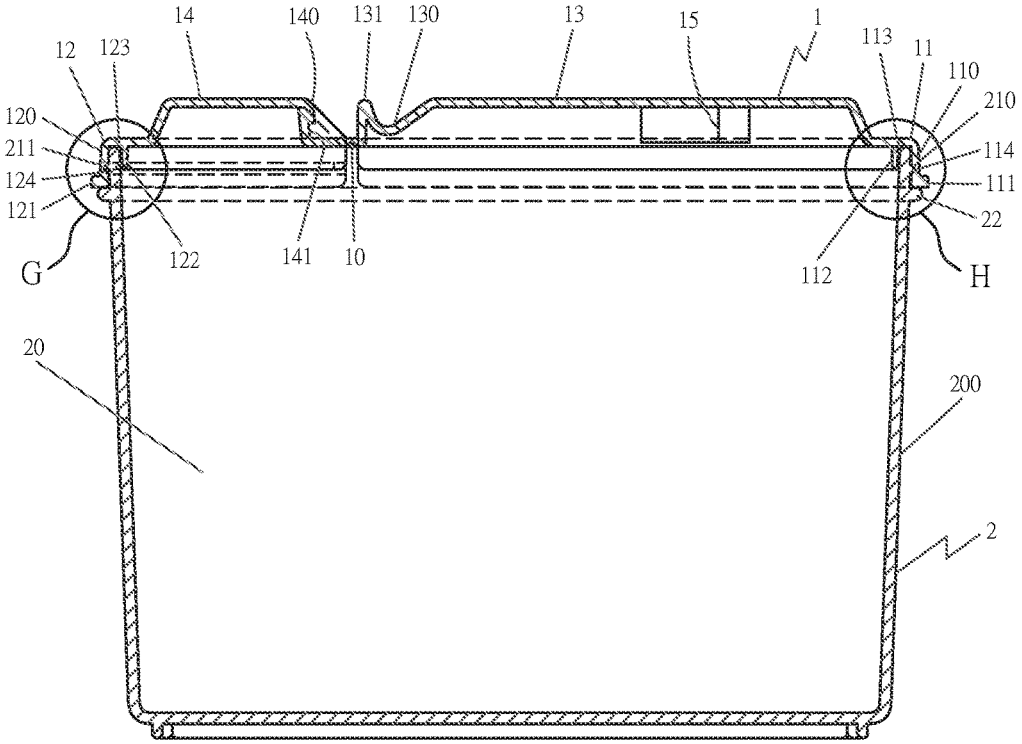
FIG. 16 is a sectional view of the receptacle base in the present invention.
Figure 17:
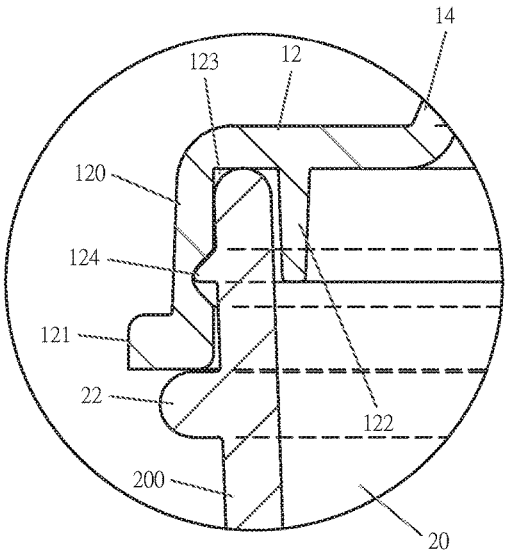
FIG. 17 is an enlarged view of area G shown in FIG. 16.
Figure 18:
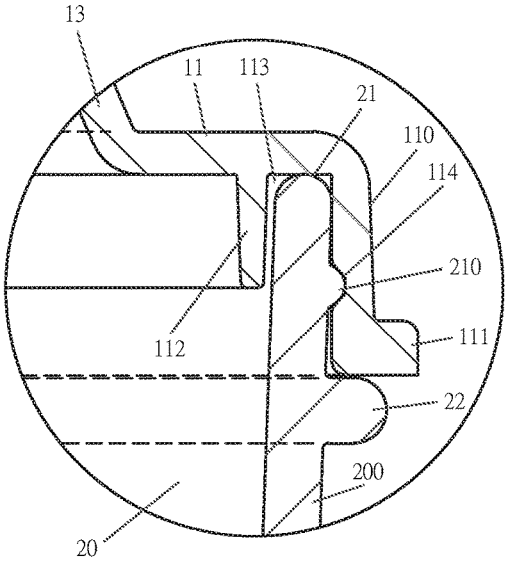
FIG. 18 is an enlarged view of area H shown in FIG. 16.
Figure 19:
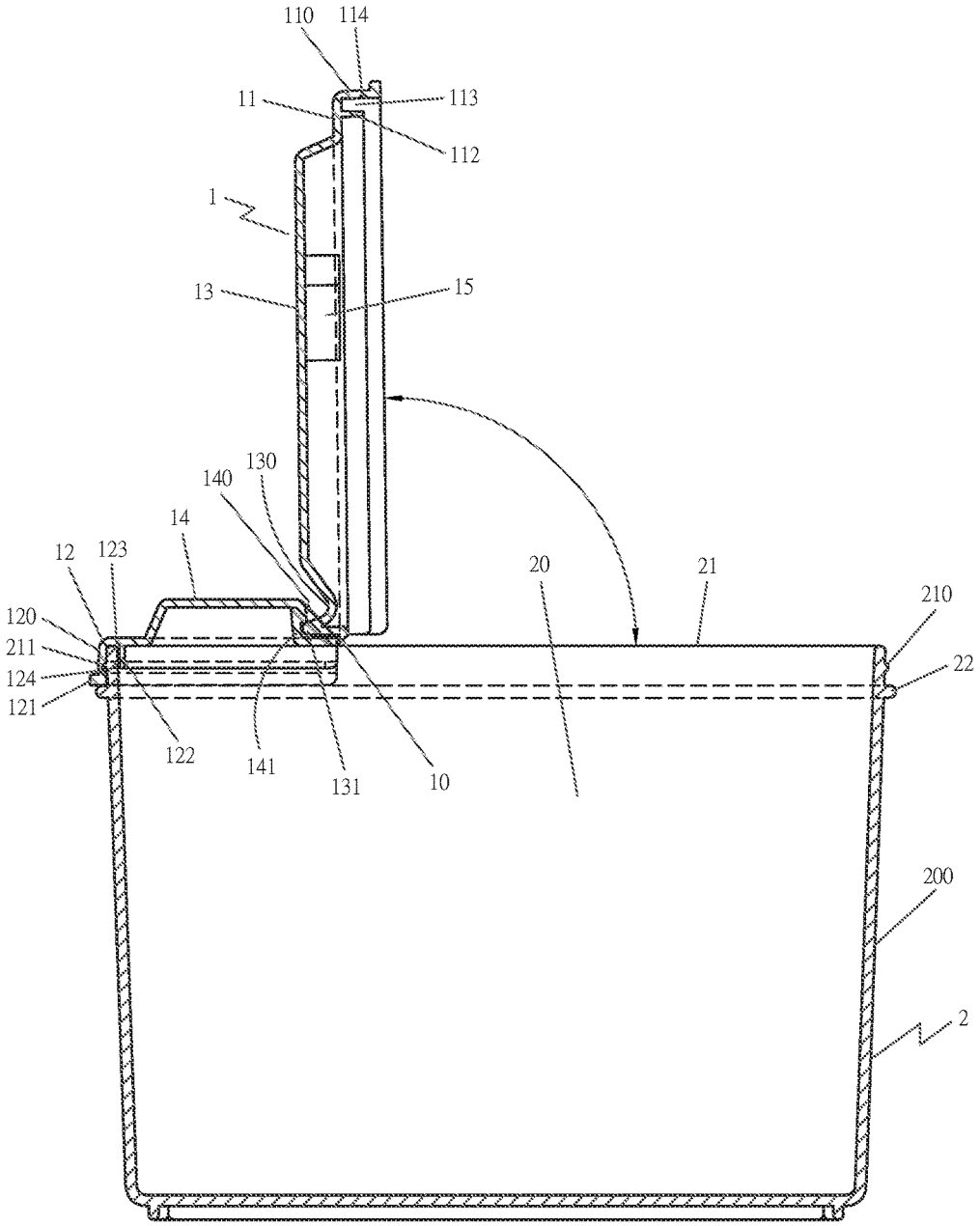
FIG. 19 is a sectional view of the fastener container in the present invention, wherein the first section of lid is in the open position.

As shown in FIGS. 16 to 18, when the lid 1 is engaged with the receptacle base 2, the first groove 113 and the second groove 123 of the lid 1, and the engaging circumference 21 of the receptacle base 2 are combined with each other. The first recess 114 of the first section 11 and the second recess 124 of the second section 12 are fitted to the first engaging flange 210 and the second engaging flange 211 of the receptacle base 2, respectively. So that the lid 1 can be tightly engaged with the receptacle base 2.

As shown in FIGS. 21, when the user wants to take or place the screws or items from the receptacle base 2, he/she can pull off the first section 11 of the lid 1 and press the pressing member 131 of the first portion 11 through the blocking member 140 of the second portion 12, then the pressing member 131 will be stuck inside the third recess 141 and hold the first section 11 of the lid 1 in the open position to facilitate the user to reach his/her hand into the receptacle base 2 to take or put the screws or other items.

On the contrary, if the user wants to close the first section 11 of the lid 1, he/she just need to depress the first section 11 of the lid 1 and separate the pressing member 131 from the third recess 141, and then pressing the first section 11 downward to the receptacle base 2 to let the first engaging flange 210 of the receptacle base 2 tightly fit inside the first recess 114 of the first section 11. So that the first section 11 of the lid 1 and the receptacle base 2 can be restored to the tightly engaged state to prevent the screw or other items from falling out.

Therefore, this invention used the first prominent portion 13 with flexible cushioning effect and the pressing member 131 of the first prominent portion 13, and the blocking member 140 and the third recess 141 of the second prominent portion 14 to reduce the wear and tear between the pressing member 131 and the blocking member 140, it also can prevent the pressing member 131 from squeezing the blocking member 140 for a long time to result in a problem that the pressing member 131 and the blocking member 140 are deformed and the first section 11 can not be held in the open position, so that the service life of the lid 1 can be extended and the user can easily open or close the first section 11 of the lid 1 to take or place screws or other items. Evidently this invention has tangible benefits and tallies with progressiveness and novelty demanded by patent laws.

While the preferred embodiments of this invention have been described above, it will be recognized and understood that various modifications may be made therein and appended claims are intended to cover all such modifications that may fall within the spirit and scope of the invention.

What is claimed is:

1. A fastener container at least comprising:

a lid made of elastic material and a receptacle base, wherein:

said lid has a first section and a second section which are connected by a hinge; the periphery of said first section and second section are respectively provided with a first circumferential wall and a second circumferential wall;

a first inner circumference is provided inside the first circumferential wall of the first section, and a first groove is formed between the first circumferential wall and the first inner circumference, a first recess is set on the inner surface of said first circumferential wall; a second inner circumference is provided inside the second circumferential wall of the second section, and a second groove is formed between the second circumferential wall and the second inner circumference, a second recess is set on the inner surface of said second circumferential wall;

the first section of the lid has a first prominent portion, a curved long groove is provided on the rear side of the first prominent portion and parallel to said hinge, a pressing member is set on the rear side of the curved long groove, said curved long groove is used to provide the effect that the pressing member is elastically cushioned when the pressing member is pressed; the second section of the lid has a second prominent portion, a blocking member is provided on the front side of the second prominent portion and parallel to said hinge, a third recess is set below the blocking member, so that the pressing member passing through the blocking member can be confined in the third recess; the underside of the first prominent portion of the lid is provided with a tool holder; and the receptacle base is made of elastic material, said receptacle base has a space and an annular side wall of the receptacle base is provided in conformance with the shape of the lid, an engaging circumference is set on the top of the receptacle base; the front side of said engaging circumference has a first engaging flange which is provided to match with said first recess, and the rear side of said engaging circumference has a second engaging flange which is provided to match with said second recess.

2. The fastener container according to claim 1, wherein said first reinforced ring and a second reinforced ring are separately set on the bottom of said first circumferential wall and second circumferential wall to strengthen the structural strength of the circumferential wall.

3. The fastener container according to claim 1, wherein said first groove and second groove of the lid are engaged with each other to form an annular groove.

4. The fastener container according to claim 1, wherein said pressing member is a rib.

5. The fastener container according to claim 1, wherein said pressing member is a plurality of spaced projections, the spaced projections allows the pressing member to be more easily pressed into the third recess.

6. The fastener container according to claim 1, wherein said tool holder is a V-shaped holder.

7. The fastener container according to claim 1, wherein said tool holder is a U-shaped holder.

8. The fastener container according to claim 1, wherein a protrudent ring is provided between said annular side wall and engaging circumference to strengthen the structure of the receptacle base and to limit the final engaging position and depth of the lid.

9. The fastener container according to claim 1, wherein the total length of the first engaging flange is less than the total length of the second engaging flange, so that the first section will be easier to open than the second section.

10. The fastener container according to claim 1, wherein said lid and receptacle base are made of plastic.

11. The fastener container according to claim 1, wherein said lid and receptacle base are made of rubber.

* * * * *